United States Patent [19]

Sande

[11] Patent Number: 4,484,705

[45] Date of Patent: Nov. 27, 1984

[54] ADJUSTABLE AND PIVOTAL MAILBOX SUPPORT

[76] Inventor: Lloyd P. Sande, Box 46, West Star Rte., Two Harbors, Minn. 55616

[21] Appl. No.: 498,409

[22] Filed: May 26, 1983

[51] Int. Cl.[3] ..... B65D 91/00

[52] U.S. Cl. ..... 232/39; 248/132

[58] Field of Search ..... 232/17, 38, 39; 248/131, 132, 146, 218.4, 219.1, 219.3

[56] References Cited

U.S. PATENT DOCUMENTS

| | | | |
|---|---|---|---|
| 1,476,607 | 12/1923 | Hanson | 248/132 |
| 2,172,742 | 9/1939 | Matthai | 232/39 |
| 3,870,262 | 3/1975 | Manning, Jr. | 232/39 X |
| 4,286,747 | 9/1981 | Deike | 232/39 |
| 4,300,739 | 11/1981 | Sande | 248/146 X |
| 4,403,730 | 9/1983 | Batson | 232/39 |

*Primary Examiner*—Robert P. Swiatek

[57] ABSTRACT

A mailbox support which has an elongated frame slidably fitted between diagonal brackets on a collar attached to a pole, the frame being pivotal about its contact points against the brackets, and the collar being adjustably clamped against the pole between a plate and a facing U-channel.

3 Claims, 5 Drawing Figures

ADJUSTABLE AND PIVOTAL MAILBOX SUPPORT

BACKGROUND OF THE INVENTION

This invention is an improvement over my prior invention entitled "Adjustable Pole-Mounted Mail Box Support", U.S. Pat. No. 4,300,739, issued Nov. 17, 1981. The invention relates generally to a mailbox support which may be adjustably mounted on a fixed pole.

SUMMARY OF THE INVENTION

In mounting a conventional mailbox on a support such as a pole anchored in the ground in a vertical position, there is generally a requirement relative to the positioning of the box with regard to various terrain, access to a driver of a mail truck and in northern climes a buildup of snow and ice.

It is, therefore, an object of the invention to provide a support for a mailbox which may be adjusted to various heights on a vertically disposed pole and in a horizontal plane 360° about a vertical pole to accommodate terrain, access to the mailbox and snow buildups. It is an additional object to provide a support for a mailbox which also allows the mailbox to be adjustably positioned horizontally relative to the support and the pole on which the support is mounted.

It is a further object of the invention to provide a conveniently pivotable mailbox and support which may be upwardly pivoted relative to the support pole to provide ready access for cleaning away snow accumulations from the area below the mailbox.

The invention will appear more clearly from the following detailed description when taken in connection with the accompanying drawings, showing by way of example a preferred embodiment of the inventive idea wherein like numerals refer to like parts throughout.

BRIEF DESCRIPTION OF THE DRAWINGS

In the drawings forming part of this application.

DESCRIPTION OF THE PREFERRED EMBODIMENT

Figure 3:
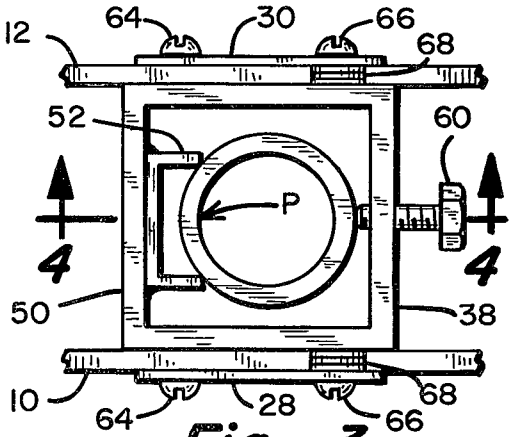
FIG. 3 is a view on the line 3—3 of FIG. 1.
Figure 4:
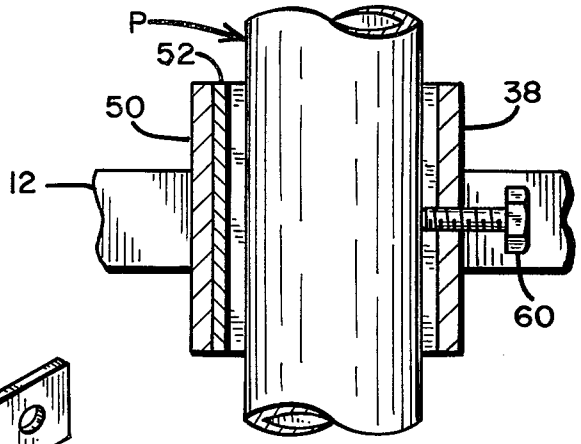
FIG. 4 is a sectional view on the line 4—4 of FIG. 3.

Referring to the drawings in detail, the mailbox support A includes first and second spaced elongated side support members 10 and 12, respectively connected at one end by the end cross bar or spacer members 14 and at the other end by the flat cross bar or bridging member 16 formed with the spaced holes 18 and 20. A further flat cross bar 22 is provided at the end area of the bar 16 and it has the spaced holes 24 and 26. The side members 10 and 12 together with the cross bar 14 and the flat cross bar 16 constitute a frame F.

The numeral 32 designates the rectangular collar which includes first and second sidewalls 34 and 36, respectively, connected at one edge by the end wall 38 having the threaded hole 40. The sidewall 34 has formed therein the spaced threaded holes 42 and 44, and the sidewall 36 has similar spaced threaded holes.

The collar 32 also includes the front wall 50 connected to the sidewalls 34 and 36, and secured against the inner surface of front wall 50 is a U-shaped channel 52, which extends generally along the entire height of front wall 52.

The numeral 60 designates a bolt engageable in the threaded hole 40, the bolt engageable with the post P.

A pair of brackets 28, 30 are respectively attached to sidewalls 34 and 36. Bracket 28 is attached by means of bolts 64 and 66 and spacers 66 to threaded holes 42 and 44. Bracket 30 is similarly attached to sidewall 36.

The frame F is adjustably mounted on the collar 32 by means of bolts 64 and 66 inserted through bracket 28 and threadedly engaged in a pair of threaded holes 42 and 44. Similarly, identical bolts 64 and 66 are inserted through a pair of holes in bracket 30 and threadedly engaged in a pair of holes in sidewall 36, thereby mounting the frame F on the collar. It will be noted that the side members 10 and 12 may be mounted to extend more or less from the collar by sliding frame F in the direction of arrow 70, depending on the requirement of location of the mailbox M secured to the top of the side members 10 and 12. The box M is secured to the top of the side members 10 and 12 by means of the screws 72 secured through the holes 18, 20, 24 and 26 of the bars 16, 22, respectively, and into the bottom of the box M.

The frame F may be adjusted vertically on the post P by positioning the post between the legs of U-channel 52 and sliding upwardly or downwardly, whereby the pole is aligned and secured with the tightening bolt 60 With the frame F at the desired height on the pole the bolt 60 is tightened to cause the inner end to tightly engage the pole and force the pole in the U-channel 52. The frame F may also be adjustably rotated 360° about the axis of the pole to any desired position and then secured by tightening the bolt 60.

Figure 5:
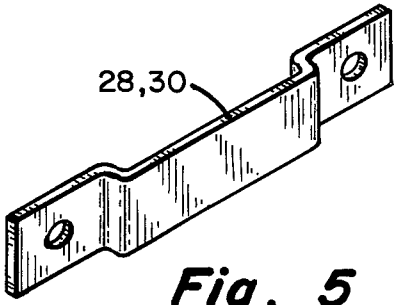
FIG. 5 is an alternative construction for the support.
Figure 2:
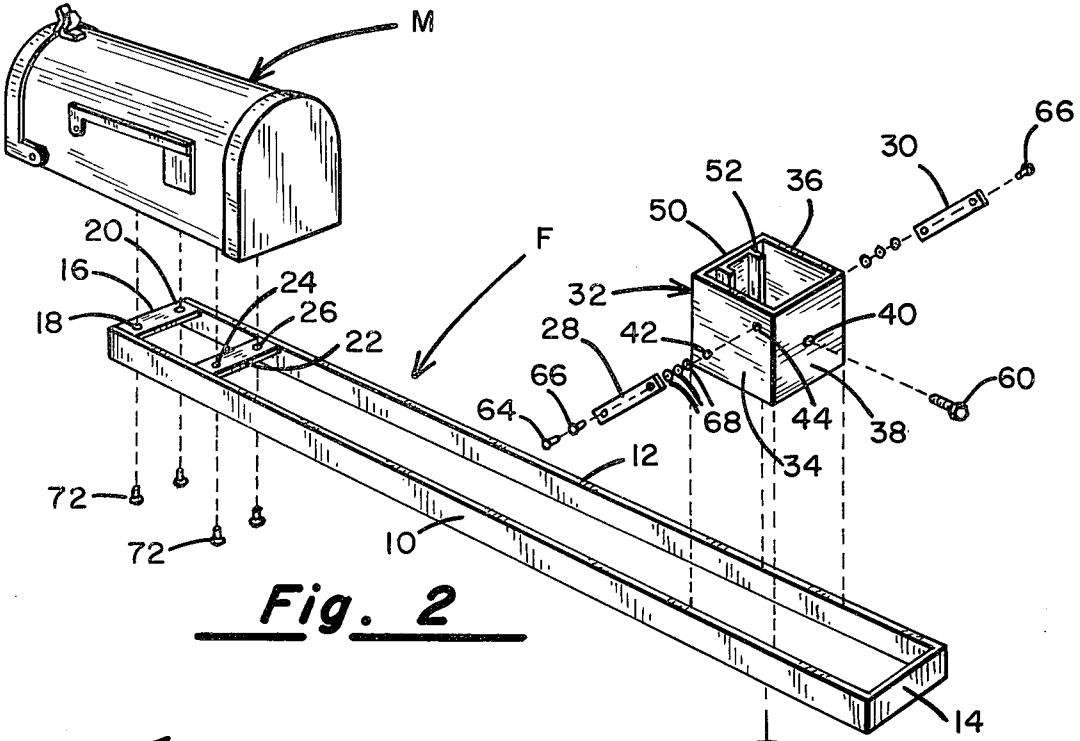
FIG. 2 is an exploded perspective view of the support.
Figure 1:
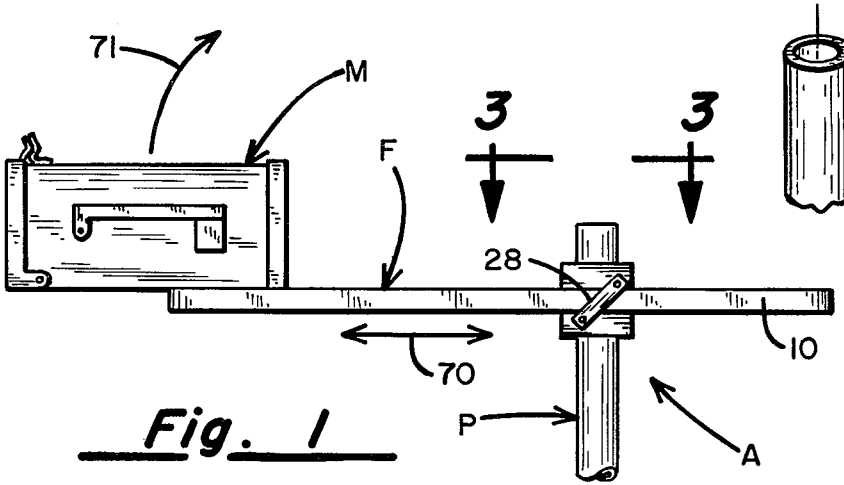
FIG. 1 is a side elevational view of an adjustable pole mounted mailbox support embodying the invention.

FIG. 5 shows an alternative construction of bracket 28 or 30, wherein a raised center portion is created on the bracket to accommodate frame F. The height of this raised center portion may be approximately the same dimension as the thickness of side support members 10 or 12.

Frame F is clamped by brackets 28 and 30 against collar 32 with the mailbox M extending outwardly from frame F. The weight of frame F and mailbox M is sufficiently heavier than the rearwardly extending portion of frame F as to hold mailbox M in a horizontal position, regardless of whether the clamping force of brackets 28 and 30 is tight or loose. In this preferred embodiment it is desirable to maintain a relatively loose clamping force between brackets 28, 30 and frame F, to permit certain relative movements hereafter described. In the event that snow or other accumulations are to be cleared away from the vicinity of the mailbox, the mailbox and frame F may be pivotally moved upwardly as shown by arrow 71, to cause the assembly to swing clear of the area to be cleared. In the event a snowplow is to pass by the mailbox, the mailbox and frame F may be pivoted upwardly and left in a vertical position for a time until the snowplow passes.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed is:

1. An adjustable pole-mounted mailbox support, comprising:

(a) an elongated support frame, including first and second spaced side members and a bridging member between said first and second spaced side members proximate a forward end of said support frame, and including a spacer member between said first and second spaced side members proximate a rearward end of said support frame;

(b) a collar, having first and second spaced sidewalls connected to a front and rear wall;

(c) a bracket adjustably secured along a diagonal line on each of said first and second sidewalls, each of said brackets being at a lower position proximate said front wall and at a higher position proximate said rear wall, said first and second spaced side members respectively fitted between a bracket and one of said sidewalls, said support frame contacting said brackets at a forward lower position and at a rearward higher position along said first and second spaced side members;

(d) means for adjustably positioning said collar on a pole to place said frame at various positions on a pole, including a bolt carried by said rear wall for pressure engagement with said pole; and (e) means for securing a mailbox on said bridging member of said support frame.

2. The support of claim 1, wherein said means for adjustably positioning further comprises a U channel attached along said collar front wall and facing said pole.

3. The support of claim 1, wherein said bracket further comprises a strap having a raised center portion and respective end portions having holes therethrough.

* * * * *